US010132111B2

(12) United States Patent
Swann et al.

(10) Patent No.: US 10,132,111 B2
(45) Date of Patent: Nov. 20, 2018

(54) BUMP STOP ASSEMBLY

(71) Applicant: FORD GLOBAL TECHNOLOGIES, LLC, Dearborn, MI (US)

(72) Inventors: Robert Swann, Rayleigh (GB); Brian Westgarth, Billericay (GB)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 0 days.

(21) Appl. No.: 15/079,997

(22) Filed: Mar. 24, 2016

(65) Prior Publication Data

US 2016/0305174 A1 Oct. 20, 2016

(30) Foreign Application Priority Data

Apr. 20, 2015 (GB) ..... 1506656.6

(51) Int. Cl.
*E05F 5/02* (2006.01)

(52) U.S. Cl.
CPC ..... *E05F 5/025* (2013.01); *E05F 5/022* (2013.01); *E05Y 2400/82* (2013.01); *E05Y 2600/56* (2013.01)

(58) Field of Classification Search
CPC ..... E05F 5/02; E05F 5/022; E05F 5/025
See application file for complete search history.

(56) References Cited

U.S. PATENT DOCUMENTS 4,090,606 A * 5/1978 Dawson ..... B65D 85/40 206/223
4,142,391 A * 3/1979 Paig ..... E05B 17/0004 70/461
5,010,656 A * 4/1991 Broselow ..... A61B 5/107 33/512
5,884,408 A * 3/1999 Simmons ..... G01B 3/004 33/494
6,385,858 B1 * 5/2002 Muller ..... E04F 21/0092 33/526
6,857,166 B2 * 2/2005 Nakagaki ..... E05F 5/022 16/86 R
7,552,953 B2 6/2009 Schmoll et al.
(Continued)

FOREIGN PATENT DOCUMENTS

DE 10337613 A1 5/2005
DE 102009022807 A1 12/2010
(Continued)

OTHER PUBLICATIONS

Intellectual Property Office, Combined Search and Examination Report for corresponding Great Britain Patent Application No. GB1506656.6 dated Oct. 21, 2015.

*Primary Examiner* — Jeffrey O'Brien
(74) *Attorney, Agent, or Firm* — Jason Rogers; Brooks Kushman P.C.

(57) ABSTRACT

A bump stop assembly is provided for an access door. The assembly comprises a bump stop configured to couple to the access door or a door frame and a door closure gauge movably coupled to the bump stop. A closure pad couples the bump top to one of the door frame or the access door. The closure pad engages the other side of the access door and door frame when the door is closed. The thickness of a selected closure pad is determined based upon the extent that the door closure gauge protrudes relative to the bump stop.

14 Claims, 3 Drawing Sheets

(56) References Cited

U.S. PATENT DOCUMENTS 7,566,081 B2 * 7/2009 Aoyama ..... E05F 5/022 293/104
8,056,965 B2 * 11/2011 Rosemann ..... E05F 5/022 16/86 A
8,291,547 B2 * 10/2012 Ukai ..... F16B 21/086 16/86 R
8,407,857 B2 * 4/2013 Sugiyama ..... F16F 1/371 16/86 R
8,414,024 B1 4/2013 Kalisz et al.
8,677,563 B2 * 3/2014 Diep ..... E05F 5/08 16/82
8,984,715 B2 * 3/2015 Kaji ..... E05F 5/022 16/86 R
D779,313 S * 2/2017 Ukai ..... F16F 1/44 D8/382
9,670,710 B2 * 6/2017 Kwak ..... E05F 5/022
2004/0025290 A1 * 2/2004 Novarino ..... E05F 5/022 16/86 A
2010/0192335 A1 * 8/2010 Ukai ..... F16F 1/373 24/591.1
2011/0167590 A1 * 7/2011 Ukai ..... E05F 5/022 16/85
2012/0246896 A1 10/2012 Kaji et al.
2014/0196261 A1 * 7/2014 Kamiya ..... E05F 5/022 24/591.1
2015/0121665 A1 * 5/2015 Kaji ..... F16B 21/086 24/458
2017/0176159 A1 * 6/2017 Moreau ..... G01B 3/1082

FOREIGN PATENT DOCUMENTS

EP 0113095 4/1989
EP 2562339 2/2013
JP 2003202043 A 7/2003
JP 2012116224 A 6/2012

* cited by examiner

BUMP STOP ASSEMBLY

CROSS-REFERENCE TO RELATED APPLICATIONS

This application claims foreign priority benefits under 35 U.S.C. § 119(a)-(d) to GB 1506656.6 filed Apr. 20, 2015, which is hereby incorporated by reference in its entirety.

TECHNICAL FIELD

The present invention relates to a bump stop assembly for the door of a motor vehicle and is particularly, although not exclusively, concerned with a bump stop assembly that ensures correct closure of an access door of the vehicle.

BACKGROUND

When a door of a vehicle is closed, a latch within the door mechanism engages to prevent the door from opening unintentionally. The latch often allows some movement of the door relative to the body of the vehicle. Because of this freedom of movement, the door may rattle as it is closed and the edges of the door panel may not always be aligned with the surrounding body panels.

In order to ensure the door of the vehicle is correctly aligned with the surrounding body panels and to ensure the door does not rattle as it is being closed, a bump stop can be fitted to the door or the door frame. The bump stop is often configured such that, when the door is closed and correctly aligned with the surrounding body panels, the bump stop fills the gap between the door and the door frame, preventing the door from closing any further. By restricting the movement of the door in this way, rattling of the door may be reduced.

Adjustment of the bump stop, to ensure it correctly fills the gap between the door and the door frame, is often performed by hand. The door may be opened and closed several times while the bump stop is being adjusted, until it is judged that the door is correctly aligned with the adjacent panels of the vehicle.

This process is unreliable and different results are achieved depending on the vehicle and the person adjusting the bump stop. Restricted access to the bump stop when the door is closed prevents the use of many tools or aids which might be used to allow the bump stop to be adjusted consistently.

With reference to FIG. 1, a bump stop 4 for an access door 10 of a vehicle is shown. The bump stop 4 may be coupled to the door 10 via a thread 4*a* on a shaft portion of the bump stop. The bump stop further comprises a stop face 4*c* configured to contact a door frame 12 that surrounds the door when closed. The bump stop 4 may be rotated and axially adjusted with the thread so that the stop face 4*c* engages the door frame 12 when the door is closed. In FIG. 1, the bump stop 4 has not been configured correctly and a gap is present between the bump stop 4 and the door frame 12. This gap may lead to the door panel being misaligned with the surrounding body panels and may allow the door to rattle when it is closed.

SUMMARY

According to a first aspect of the present disclosure, a bump stop assembly is provided for a motor vehicle that is configured to be coupled to an access door or a door frame. A door closure gauge is movably coupled to, e.g. slidably received in, the bump stop. A closure pad is configured to couple to the bump stop to one of the door frame or the access door and engage with the other of the door frame or the access door when the door is closed. The thickness of the closure pad required in the bump stop assembly can be determined from the extent of the protrusion of the door closure gauge relative to the bump stop.

The door closure gauge may comprise a measurement scale from which the protrusion of the door closure gauge from the bump stop can be determined. The door closure gauge may be color coded, such that the extent that the door closure gauge protrudes from the bump stop can be determined from the color or colors of the protruding part of the door closure gauge.

The closure pad may be at least partially colored, wherein the color corresponds to the thickness of the closure pad. The color coding of the door closure gauge may correspond to the color of the closure pad. The color or colors of the portion of the door closure gauge protruding from the bump stop indicate the color of the required closure pad. The color of the closure pad may not be visible when assembled into the bump stop assembly.

The closure pad may comprise a coupling portion configured to couple to the bump stop or the door frame or access door and an engaging portion configured to engage the other of the door frame or door of the vehicle or the bump stop. The coupling portion and the engaging portion of the closure pad may be separate components.

The coupling portion of the closure pad may be configured to couple with a range of engaging portions ranging in size. The coupling portion of the closure pad may be configured to directly engage the door frame or door of the vehicle or the bump stop.

The bump stop or the closure pad may be coupled to the access door or the door frame by a thread provided on the respective bump stop or closure pad.

According to another aspect of the present disclosure, a door closure gauge is provided for use in the bump stop assembly according to any of the above mentioned aspects of the disclosure.

According to another aspect of the present disclosure, a bump stop is provided for use in the bump stop assembly according to any of the above mentioned aspects of the disclosure.

According to another aspect of the present disclosure, a closure pad is provided for use in the bump stop assembly according to any of the above mentioned aspects of the disclosure.

According to another aspect of the present disclosure, a kit of parts is provided that includes two or more closure pads. The closure pads are configured to be coupled to a bump stop or a door or door frame. The closure pads engage the door, door frame, or the bump stop when the access door is closed. Each of the closure pads provided by the kit is a different thickness.

The kit may comprise a set of closure pads of different thicknesses. The kit may comprise a coupling portion of the closure pad and one or more engaging portions of the closure pad.

The closure pads may be color coded with the color corresponding to the thickness of the closure pad. The color may not be visible after the closure pad is coupled to the bump stop and the access door or the door frame.

According to another aspect of the present disclosure, a method is provided of setting the closure of an access door. The method comprises coupling a bump stop to the access door or a door frame. The bump stop is provided with a door closure gauge that is movably coupled to the bump stop. The door is closed until the door latches and is correctly aligned with the body of the vehicle. The door is opened and the extent that the door closure gauge protrudes from the bump stop is determined. A closure pad of appropriate thickness is coupled to the other of the door frame, the access door, or the bump stop, such that it engages with the bump stop, the access door, or door frame when the door is closed.

The extent that the door closure gauge protrudes from the bump stop may be determined by referring to a measurement scale provided on the door closure gauge. The extent the door closure gauge protrudes from the bump stop may be determined based upon the color or colors of a portion of the door closure gauge protruding from the bump stop.

The method may further comprise selecting a closure pad of the correct thickness from a set of closure pads of different thicknesses. Each closure pad in the set may be at least partially colored with the color corresponding to the thickness of the closure pad. The closure pad of the correct thickness may be selected by matching the color of the closure pad to the color or colors of the protruding portion of the door closure gauge.

For a better understanding of the present disclosure, and to show more clearly how it may be carried into effect, reference will now be made, by way of example, to the accompanying drawings, in which:

DETAILED DESCRIPTION

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Figure 1:
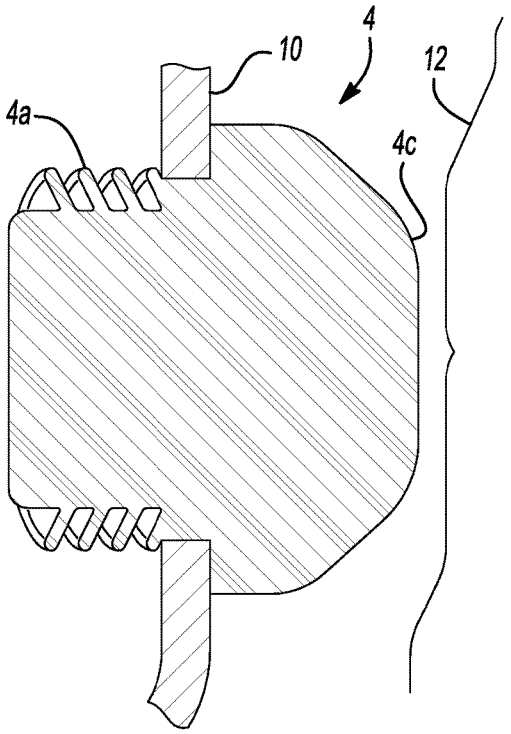
Fig-1 PRIOR ART
FIG. 1 is a sectional view of a prior art bump stop fitted to a door of a vehicle.
Figure 2:
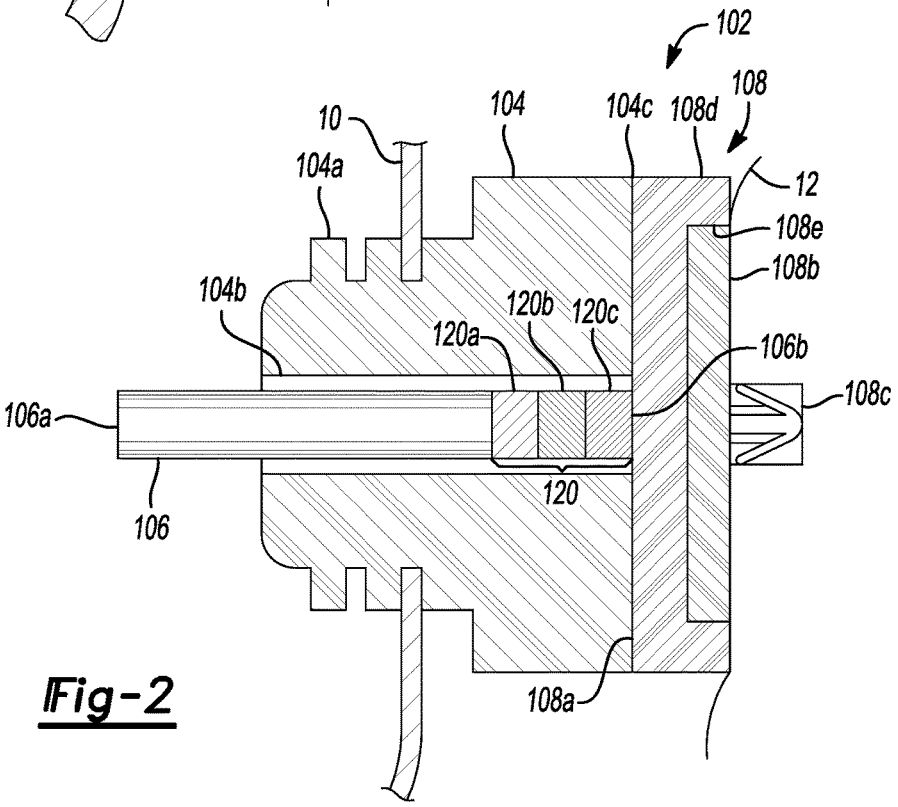
FIG. 2 is a schematic sectional view of a bump stop assembly according to an example of the present disclosure.

With reference to FIG. 2, a bump stop assembly 102 according to an example of the present disclosure comprises a bump stop 104, a door closure gauge 106 and a closure pad 108. The bump stop 104 may be coupled to an access door 10 of a vehicle, such as a passenger/driver door, bonnet, boot or any other access panel or hatch. The bump stop comprises a connecting portion 104*a* connected to the door 10 that secures the bump stop in place. The connecting portion 104*a* may comprise a barbed connector, such as a fir tree connector. The fir tree connector is deformable to be passed through a hole in the door 10. A resilient barb of the fir tree connector prevents the bump stop from detaching from the door 10. Alternatively, the connecting portion 104*a* may comprise any other connecting means suitable for connecting the bump stop to the access door 10 or the door frame 12.

An abutment surface 104*c* of the bump stop 104 may be in contact with the closure pad 108 when the door is closed. The abutment surface 104*c* may contact a closure surface 108*a* of the closure pad. The closure pad 108 may be coupled to a door frame 12. Alternatively, the closure pad 108 may be coupled to the abutment surface 104*c* of the bump stop 104. The combined thickness of the bump stop 104 and the closure pad 108 may fill the gap between the door 10 and the door frame 12 when the access door 10 is closed. The thickness of the bump stop 104 and the closure pad 108 may be selected to ensure that there is no gap present between the two components so that the door will not rattle when closed. The combined thickness of the bump stop 104 and the closure pad 108 correctly aligned the door 10 with the body panels of the vehicle adjacent to the door.

The door closure gauge 106 may be movably coupled to the bump stop 104. For example, as shown in FIG. 2, the bump stop 104 may comprise an axial bore 104*b* that is adapted to slidably receive the door closure gauge 106. Alternatively, the door closure gauge 106 may be pivotally supported at an axis of the bump stop.

The door closure gauge 106 may comprise a shaft with a substantially constant cross-section along the length of the shaft. For example, the cross-section of the door closure gauge 106 may be substantially circular. Alternatively, the cross-section may be any other shape such as substantially square or rectangular. In any event, the door closure gauge 106 cross-section may correspond to the shape of the axial bore 104*b* of the bump stop 104. The door closure gauge may form a tight fit with the axial bore 104*b*. The door closure gauge may be ribbed or comprise any other surface feature in order to prevent unwanted movement of the door closure gauge 106 within the axial bore 104*b*. The length of the door closure gauge may be greater than a maximum anticipated tolerance or combination of tolerances affecting the gap between the access door 10 and the door frame 12.

The door closure gauge may be used, as described below, to determine the correct thickness of closure pad 108 to use within the bump stop assembly 102. The door closure gauge has a first end 106*a* and a second end 106*b*. A measurement scale 120 may be provided at or near the second end 106*b* of the door closure gauge. The measurement scale may indicate a length from the second end 106*b* of the door closure gauge to a point on the measurement scale 120. In the example shown in FIG. 2, the measurement scale 120 comprises three bands of different colors 120*a*, 120*b*, 120*c*, which are axially spaced along the door closure gauge. It is also envisaged that the measurement scale may comprise different numbers of bands of different colors. The measurement scale 120 may include a series of graduations indicating a length, for example in millimeters. It will be appreciated that the measurement scale may comprise any other markings or surface features capable of indicating a length. The measurement scale may extend over a length greater than the maximum anticipated tolerance stack-up of the parts forming the gap between the access door 10 and the door frame 12.

As depicted in FIG. 2, when the bump stop assembly 102 is fully assembled, the second end 106*b* of the door closure gauge 106 may be substantially aligned with the abutment surface 104*c* of the bump stop 104 and may contact the closure surface 108*a* of the closure pad 108 when the door is closed.

The closure pad 108 may comprise a coupling portion 108*b* and an engaging portion 108*d*. As depicted in FIG. 2, the closure surface 108*a* of the closure pad may be provided on the engaging portion 108*d*. The engaging portion 108*d* and the coupling portion 108*b* of the closure pad may be separate components that are assembled to form the closure pad 108. As shown in FIG. 2, the engaging portion 108*d* may comprise a recess 108*e* with a rim extending circumferentially around its edge. The coupling portion 108*b* may be received within the recess 108*e* and may form an interference fit with the inside surface of the rim. The coupling portion 108*b* may itself comprise a recess configured to receive a portion of the engaging portion 108*d*. An adhesive may be used to assemble the coupling portion 108*b* with the engaging portion 108*d*. Alternatively, the closure pad 108 may be a single component comprising the coupling portion 108*b* and the engaging portion 108*d*.

The coupling portion 108*b* may comprise a connector 108*c*, for example a fir tree connector as described above with reference to the bump stop 104. The connector 108*c* may connect the coupling portion to the access door 10 or the door frame 12. Alternatively, the connector 108*c* may connect the coupling portion to the bump stop 104. For example, the connector 108*c* may be received within the axial bore 104*b* of the bump stop 104.

The coupling portion 108*b* of the closure pad used within the bump stop assembly 102 may have a constant thickness regardless of the gap present between the bump stop 104 and the door frame 12 when the door is closed. By contrast, the thickness of the engaging portion 108*d* of the closure pad used within the bump stop assembly 102 may be variable in order to provide a closure pad 108 or closure pad assembly with the desired overall thickness. For example, a range of engaging portions 108*d* may be provided which can be assembled with the coupling portion 108*b* to provide the desired thickness of closure pad 108. Alternatively, if the thinnest possible closure pad 108 is desired, no engaging portion 108*d* may be provided, and the coupling portion 108*b* may contact the abutment surface 104*c* of the bump stop directly.

As depicted in FIG. 2, the bump stop 104 may be coupled to the access door 10, and the closure pad 108 may be coupled to the door frame 12. However, it is equally envisaged that the bump stop 104 may be coupled to the door frame 12 and the closure pad 108 may be coupled to the access door 10. Alternatively, as mentioned above, the closure pad 108 may be coupled to the bump stop 104.

Figure 3:
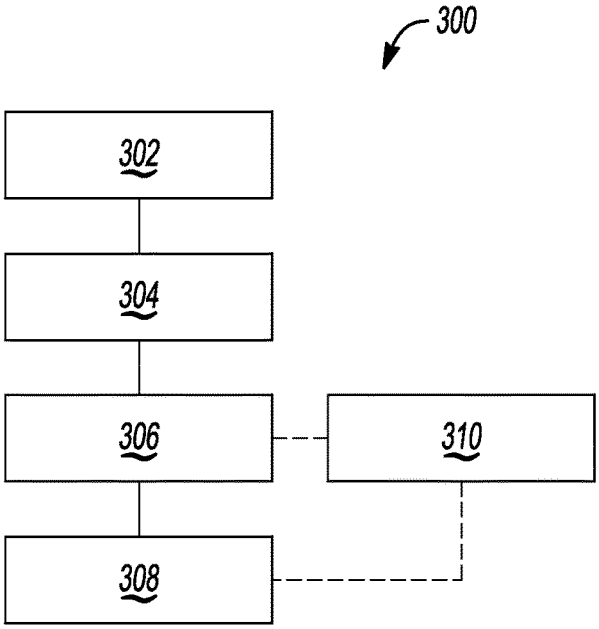
FIG. 3 shows a method for setting the closure of an access door according to an example of the present disclosure.

With reference to FIG. 3, according to an example of the present disclosure, a method 300 is described for setting the closure of the access door 10. The method 300 may comprise a first step 302, in which the bump stop 104 is coupled to the access door 10 or the door frame 12. In a second step 304, the access door 10 is closed until the door latches and is correctly aligned with the body of the vehicle. In a third step 306, the door is opened and the extent of door closure gauge 106 protruding from the bump stop is determined. In a fourth step 308, the door closure pad 108 of the correct thickness is coupled to the other of the door frame or the access door such that it engages the bump stop when the door is closed.

Figure 4A:
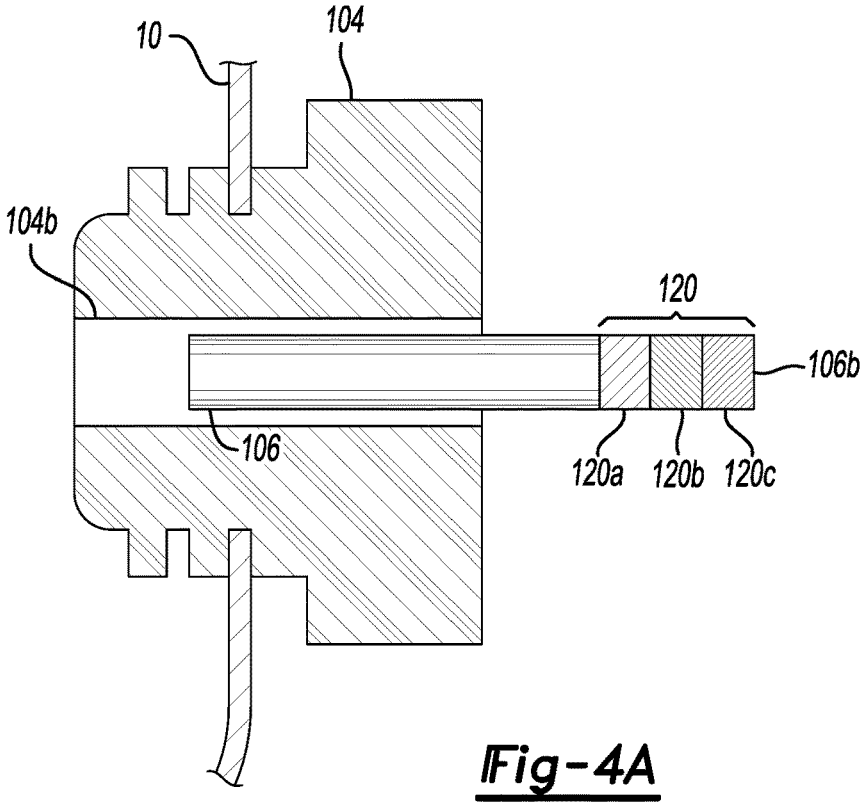
FIGS. 4*a* and 4*b* are schematic sectional views of a bump stop fitted with a door closure gauge according to an example of the present disclosure.

In FIG. 4*a*, the bump stop 104 and door closure gauge 106 are depicted after the first step 302 of the method 300 has been performed. At this point the second end 106*b* of the closure gauge 6 may be protruding from the bump stop 104 and the measurement scale 120 may protrude fully from the axial bore 104*b*.

Figure 4B:
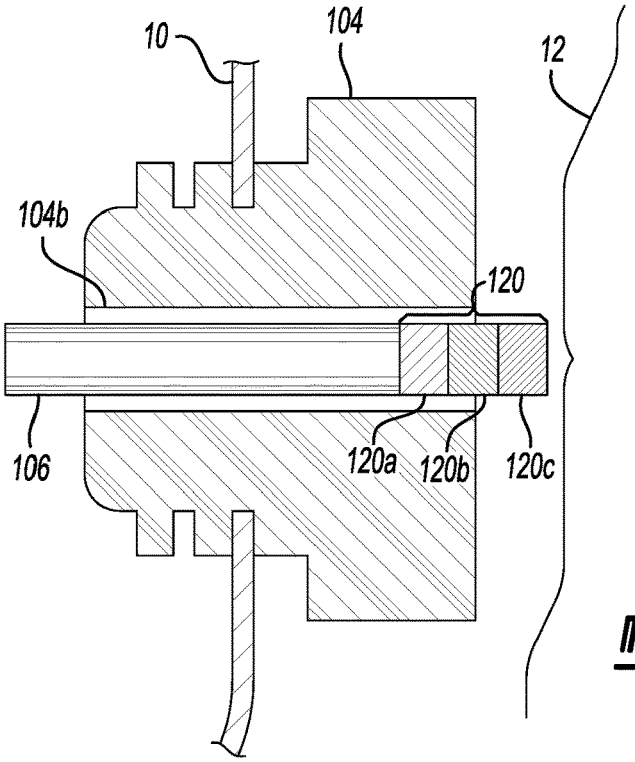

In FIG. 4*b*, the bump stop 104 and door closure gauge 106 are shown after the second step 304 of the method 300 has been completed. During this step, the access door 10 is closed and the door closure gauge 106 may be moved relative to the bump stop 104 through contact with the door frame 12 as the access door 10 is closed against it. At this stage in the method 300, the closure pad 108 has not been provided within the bump stop assembly 102 and hence a gap may be present between the bump stop 104 and the door frame 12. The gap is spanned by the protruding portion of the door closure gauge 106. As depicted in FIG. 4*b*, the measurement scale 120 may be partially received within the axial bore 104*b* of the bump stop 104 and may partially protrude therefrom. The length of the door closure gauge 106 protruding beyond the abutment surface 104*c* may therefore be determined from the protrusion of the measurement scale 120.

The position of the second end 106*b* of the door closure gauge relative to the bump stop abutment face 104*c* following the second step 304 may be affected by the manufacturing tolerances of all components in a tolerance stack between the bump stop 104 and the door frame 12. Additionally, when the door is correctly aligned with the surrounding body panels of the vehicle, tolerances affecting the position of the body panels and the door panels may also affect the gap between the bump stop and the door frame.

In the third step 306, the length of door closure gauge protruding from the bump stop 104 may be determined using any measurement process known in the art. For example, a rule, depth gauge, or set of calipers may be used to measure the protruding length. Alternatively, the measurement scale 120 may be used to measure the protruding length. As depicted in FIG. 4*b*, the first band 120*a* of the measurement scale 120 may now be within the axial bore 104*b* of the bump stop, the second band 120*b* may be protruding partially from the axial bore 104*b* and the third colored band 120*c* may be completely outside the axial bore 104*b*. The color of the second band 120*b* may thereby indicate the length of door closure gauge 106 protruding from the bump stop 104.

The method 300 may further comprise the additional step 310 of selecting a closure pad 108 of the correct thickness from a set of closure pads of different thicknesses. The thickness of the closure pad 108 may be selected such that the closure pad thickness is substantially the same as the length of protrusion of the door closure gauge 106, as determined in the third step 306.

Figure 5:
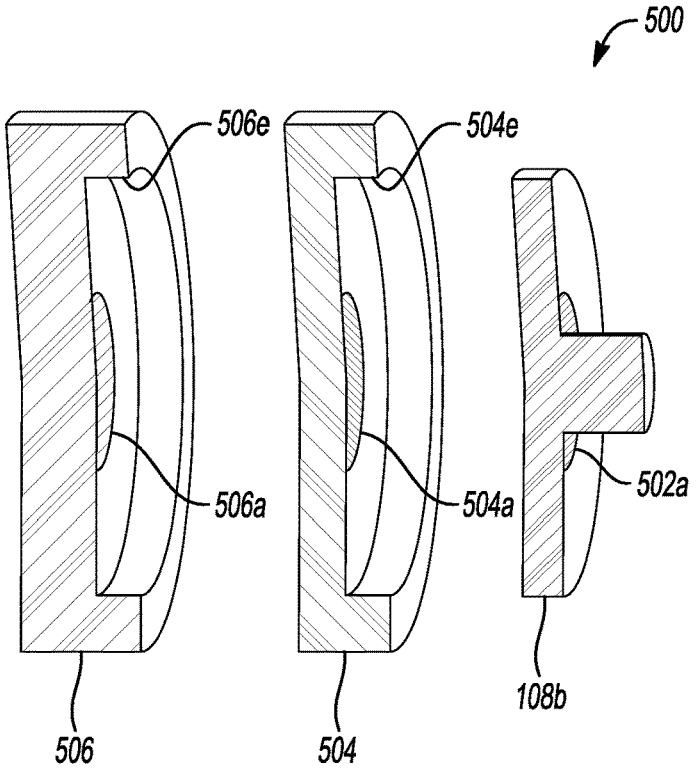
FIG. 5 is a sectional perspective view of a set of closure pads according to an example of the present disclosure.

With reference to FIG. 5, a kit of parts 500, according to an example of the present disclosure, may be assembled that provides a plurality of different closure pads. The thickness of each of the different closure pads may be different than the others. As depicted in FIG. 5, the kit may comprise a coupling portion 108*b* and one or more engaging portions, for example first and second engaging portions 504, 506. As described above with reference to FIG. 2, the coupling portion 108*b* may be used within the bump stop assembly 102 without an engaging portion 108*d* and hence the kit of parts 500 may be used to provide three different thicknesses of closure pad 108.

The different closure pads may have a range of thicknesses between 1.2 mm and 3.4 mm. For example, the coupling portion 108*b* may have a thickness of 1.2 mm, a first engaging portion 504 may have a thickness of 2.3 mm, e.g. at its rim, and a second engaging portion 506 may have a thickness of 3.4 mm, e.g. at its rim. The recess 504*e*, 506*e* provided in the first and second engaging portion is configured to receive the coupling portion 108*b*, as described above. The recess may have a depth corresponding to the thickness of the coupling portion. The overall thickness of the closure pad 108 extending proud of the frame/door may be substantially equal to the thickness of the engaging portion. Alternatively, the first and second engaging portions 504, 506 may be configured to nest such that the thickness of the closure pad may be increased by coupling successive engaging portions to the coupling portion 108*b*.

Any number of engaging portions may be provided in the kit. The range of thicknesses of closure pad and the increment between closure pad thicknesses may vary. The range of thicknesses may depend on the stack of tolerances between the bump stop and the door frame, as mentioned above.

The engagement portions 504, 506 and coupling portions 108*b* provided in the kit 500 may be color coded. For example, the coupling portion may comprise a colored portion 502*a* and the one or more engagement portions may comprise colored portions 504*a*, 506*a*. The color of each colored portion may correspond to the thickness of the coupling portion, engaging portion, or the thickness of the resulting closure pad formed from assembling the engaging portion with the coupling portion 108*b*. In each case, the color of the colored portion may match the color of the colored bands of the measurement scale 120 as shown in FIG. 4*b*. The thickness of the closure pad may be substantially equal to the protrusion of the door closure gauge 106, as indicated by the color of the measurement scale 120.

The engaging portions 504, 506 and/or coupling portion 108*b* may be configured such that the colored portion 504*a*, 506*a* of the engagement portions or coupling portion 502*a* is hidden when the closure pad 108 is assembled into the bump stop assembly 102. For example, as shown in FIG. 5, the colored portion 504*a*, 506*a* may be provided on a surface of the engaging portions that is obscured by the coupling portion 108*b* when the closure pad is assembled.

When the closure pads kit is color coded, the additional step 310 may comprise selecting the engaging portion or coupling portion with a colored portion that matches the color of the measurement scale 120 protruding from the axial bore 104*b* of the bump stop.

Rather than comprising the coupling portion 108*b* and the one or more engaging portions 504, 506, the kit may instead comprise a plurality of closure pads, each comprise a coupling portion and an engaging portion, with each closure pad being a different thickness. The kit may therefore comprise a set of closure pads of different thicknesses.

Once the method 300 has been completed, the door closure gauge 106 may be removed from the bump stop assembly 102. The door closure gauge may then be placed within the axial bore 104*b* of another bump stop 104 which is to be fitted to another door or door frame of a vehicle, e.g. the door closure gauge may be reusable. Alternatively, the door closure gauge 106 may not be removed, and when the door 10 is closed the door closure gauge 106 may be pushed by the closure pad 108 such that the door closure gauge 106 is fully received within the axial bore 104*b* and the second end 106*b* of the door closure gauge is substantially aligned with the abutment surface 104*c*, as depicted in FIG. 2. The bump stop 104 and the door closure gauge 106 may be configured to retain the door closure gauge 106 within the axial bore 104*b* of the bump stop 104 and cannot subsequently be removed. As shown in FIG. 2, the door closure gauge 106 may block the axial bore 104*b* once the bump stop assembly 102 has been fully assembled. The second end 106*b* of the door closure gauge 106 may be configured to be uniform in appearance with the abutment surface of the bump stop.

The embodiments described above are specific examples that do not describe all possible forms of this disclosure. The features of the illustrated embodiments may be combined to form further embodiments of the disclosed concepts. The words used in the specification are words of description rather than limitation. The scope of the following claims is broader than the specifically disclosed embodiments and also includes modifications of the illustrated embodiments.

What is claimed is:

1. A bump stop assembly comprising:

a bump stop defining an axial bore and being coupled to one of an access door and a door frame;

a door closure gauge received in the axial bore and partially protruding from the bump stop, wherein a portion of the gauge protruding from the axial bore is adjusted when the access door is closed; and a closure pad having a selected thickness substantially equal to the portion of the gauge protruding from the axial bore after the gauge is adjusted by closing the access door, the closure pad comprising a coupling portion coupled to the bump stop and a separate engaging portion configured to engage the other of the access door and the door frame;

the coupling portion comprising a first pad portion and a protruding connector, the connector configured to be received within the axial bore of the bump stop;

the engaging portion comprising a second pad portion and a recess, wherein the first pad portion is received within the recess.

2. The bump stop assembly of claim 1, wherein the door closure gauge further comprises a measurement scale for determining the portion of the door closure gauge protruding from the bump stop.

3. The bump stop assembly of claim 1, wherein the door closure gauge is color coded, wherein the portion of the door closure gauge protruding from the bump stop is determined based upon a color of the door closure gauge that is visible.

4. The bump stop assembly of claim 3, wherein the closure pad is at least partially colored, and wherein the color corresponds to a selected thickness of the closure pad.

5. The bump stop assembly of claim 4, wherein the color coding of the door closure gauge corresponds to the partial color of the closure pad, such that the color of a portion of the door closure gauge protruding from the bump stop corresponds to the partial color of the closure pad.

6. The bump stop assembly of claim 4, wherein the partial color of the closure pad is not visible when assembled into the bump stop assembly.

7. The bump stop assembly of claim 1, wherein the coupling portion of the closure pad is configured to couple with an engaging portion of a selected size.

8. The bump stop assembly of claim 1, wherein the bump stop is assembled to the door.

9. A bump stop assembly comprising:

a bump stop defining an axial opening and being coupled between a door and a door frame;

a shaft assembled into the axial opening with an end of the shaft protruding from the opening by a length $L_1$, wherein when the door is closed the shaft slides to protrude from the bump stop by a length $L_2$ that is less than $L_1$; and a closure pad coupled to the bump stop, the closure pad having a selected thickness substantially equal to $L_2$ and comprising a first portion coupled to the bump stop and a separate second portion configured to engage one of the access door and the door frame;

the first portion comprising a first pad portion and a protruding connector, the connector configured to be received within the axial opening of the bump stop;

the second portion comprising a second pad portion and a recess, wherein the first pad portion is received within the recess.

10. The bump stop assembly of claim 9 wherein the shaft further comprises: a measurement scale for determining a portion of the shaft protruding from the bump stop.

11. The bump stop assembly of claim 9, wherein the shaft is color coded, wherein a portion of the shaft protruding from the bump stop is determined based upon a color of the shaft that is visible.

12. The bump stop assembly of claim 9, wherein the first portion of the closure pad is configured to couple with the second portion of a selected size.

13. The bump stop assembly of claim 9, wherein the bump stop is attached to the door.

14. The bump stop assembly of claim 9, wherein the bump stop is attached to the door frame.

* * * * *